US007964003B2

(12) United States Patent
Wicks

(10) Patent No.: US 7,964,003 B2
(45) Date of Patent: Jun. 21, 2011

(54) REJUVENATION OF STORED GASOLINE

(75) Inventor: Robert Thomas Wicks, Mokena, IL (US)

(73) Assignee: Gold Eagle Co., Chicago, IL (US)

( * ) Notice: Subject to any disclaimer, the term of this patent is extended or adjusted under 35 U.S.C. 154(b) by 674 days.

(21) Appl. No.: 11/875,213

(22) Filed: Oct. 19, 2007

(65) Prior Publication Data

US 2009/0100750 A1 Apr. 23, 2009

(51) Int. Cl.
*C10L 1/06* (2006.01)
*C10L 1/185* (2006.01)

(52) U.S. Cl. ..... 44/448; 44/300; 44/451

(58) Field of Classification Search ..... 44/448, 44/300

See application file for complete search history.

(56) References Cited

U.S. PATENT DOCUMENTS 2,672,450 A * 3/1954 Pearsall ..... 510/185
2,874,033 A * 2/1959 Barnum et al. ..... 44/446
5,184,585 A 2/1993 Wilson
5,191,129 A * 3/1993 Irvine ..... 568/895
6,039,772 A * 3/2000 Orr ..... 44/359

OTHER PUBLICATIONS

"Acetone in Gasoline", www.zimbio.com website; printed Sep. 26, 2007; 4 pages.

"Acetone in Fuel Said to Increase Mileage", www.pureenergysystems.com website; printed Sep. 26, 2007; 11 pages.

* cited by examiner

*Primary Examiner* — Glenn A Caldarola
*Assistant Examiner* — Ming Cheung Po
(74) *Attorney, Agent, or Firm* — George H. Gerstman; Seyfarth Shaw LLP

(57) ABSTRACT

The method of adding to gasoline which has been stored in a container, of relatively small size for a substantial period of time to cause substantial loss of the more volatile gasoline components, an additive composition which comprises a flammable organic liquid having a Reid vapor pressure of 2 to 18 psig, to improve starting capacity of a motor fueled by said gasoline.

8 Claims, No Drawings

REJUVENATION OF STORED GASOLINE

BACKGROUND OF THE INVENTION

Gasoline powered motors are of course used in snow blowers, lawn mowers, string-type trimmers, generators, outboard motors for boats and the like, and similar uses, where the motor driven devices may be used seasonally, or otherwise not used for a lengthy period of time.

For example, a snow blower in the northern latitudes is unlikely to be used during the spring, summer, and fall periods that may extend for eight or more months. It is common that the remaining gasoline in the tank of such a device will not be drained, and the device will be stored through the hot summer, during which time, the more volatile components of the gasoline in the tank are lost. Then, when the winter season (in the case of snow blowers) arrives, substantial difficulties may be encountered by the user in restarting the motor.

By this invention, an additive solution is provided which, by simple addition to the gas tank of typically a relatively small gasoline engine, the residual gasoline in the tank can be rejuvenated for substantially easier starting. Similarly, gasoline that has been stored in a relatively small container can exhibit the same loss of its most volatile, low molecular weight components, resulting in a stored gasoline which is less effective for engine starting when it is placed in a fuel tank. This phenomenon of losing lower molecular weight, more volatile components upon lengthy storage is typically found in smaller tanks such as storage tanks which are used around the home, and fuel tanks for smaller gasoline engines, typically of the types listed above, as well as others.

DESCRIPTION OF THE INVENTION

In accordance with this invention, a method is provided which comprises the steps of: adding to gasoline which has been stored in a container typically having a volume of no more than about 25 gallons, for a period of at least about three months, an additive compound which comprises a flammable, organic liquid having a Reid vapor pressure of about 2-18 psig, in an amount of about 0.5-30 volume percent of the gasoline in the container (and in some embodiments, 5 to 20 volume percent), to improve starting capacity of a motor fueled by said gasoline. The "container" as mentioned above may be a gas tank, or it may be a storage container for gasoline. The invention may thus be useful with a vehicle gas tank such as an automobile, where the vehicle has been stored for a lengthy period of time, for example, in the hot sun, which can result in the well-known starting difficulties associated with "old" gasoline.

The Reid vapor pressure is a well known measurement, being as described in ASTM D323, IP 69, ISO 3077. The Reid Vapor Pressure (RVP) is a measure of the vapor-locking potential of the material. RVP is the vapor pressure of the material at 100° F. or 37.8° C. A stabilized gasoline Should have an RVP between 4 and 12 psig; 7.8 psig being adequate for most engines. Vapor pressure is a most important property for cold-start and warm-up of gasoline powered engines (Cold-start means that the engine is at ambient temperature, not that the ambient temperature is cold.) When the gasoline's vapor pressure is low, the engine may have to be cranked a long time before it starts. When it is extremely low, the engine may not start at all.

In some embodiments, the Reid vapor pressure may be 4 to 15 psig.

In some embodiments, it is preferred for the flammable, organic liquid of the additive described above to comprise at least 50 volume percent of an active compound selected from the groups consisting of: one or more (1) ethers of the formula ROR', where R is methyl or ethyl and R' is a branched alkyl radical of three to six carbon atoms, and (2) branched chain hydrocarbons of four to eight carbon atoms. The remainder of the flammable, organic liquid, if any, (because the liquid may comprise 100% of the above compounds as described) may comprise other flammable liquids such as higher molecular weight hydrocarbons, oxygenated organic liquids, and the like.

In some embodiments, from 10-30 volume percent of an alcohol of no more than six carbon atoms may be present in the flammable, organic liquid, in part for the purpose of sequestering of water present along with the stored gasoline in the container.

In some embodiments, from 10-30 volume percent of an aromatic hydrocarbon of no more than eight carbon atoms may be present in the flammable, organic liquid.

It is generally desirable for the flammable, organic liquid described above to comprise liquids having a collective octane rating of at least about 80, and comprising liquids that are not strong solvents against components of the gasoline engine to which they come into contact.

Thus, the active compound found in the additive of this invention, when added to old or stale gasoline, will make engines easier to start. This effect is particularly found in spark-ignition engines, with older, stored gasoline becoming useful again, and easy to start for motor operation.

If desired, the additive composition may contain an antioxidant to lengthen the shelf life of the gasoline, and a gasoline detergent such as a PIB-amine polyether amine intake deposit remover. Also, the hydrocarbons present may remove existing gum or varnish deposits. Other additives may include fuel antioxidants, detergents such as amino carboxylates, polybutylene amines (PIBA) and polyether amines (PEA).

A fuel-soluble lubricant such as an oil may also be incorporated if the gasoline being rejuvenated is intended for a two stroke engine where oil is added to the gasoline. Examples of such a lubricant are polyisobutylenes having a molecular weight between 700 and 1200, and commonly known as PIB, having low smoke, high film strength, and anti-scuffing (or 150 bright stock), derived from petroleum oil and utilized in traditional two cycle lubricating oils.

Examples of materials which may be used in the active compound as described above may include methyl-tert-butylether; ethyl-tert-butylether; tert-amylmethylether, and/or branched chain hydrocarbons such as isooctane (2,2,4-trimethyl pentane;) and other branched hexanes, heptanes and octanes.

Other candidate, flammable materials of relatively low molecular weight which may be used in the additive composition comprises alcohols such as methanol, ethanol, or isopropylanol, ketones such as acetone or methylethyl ketone, and xylene, toluene, or mixtures thereof.

The additive composition may also contain antioxidants such as phenolics, for example 2,6-di-tert-butylphenol or phenylenediamines, such as N,N'-di-sec-butyl-p-phenylnediamine. The composition may also contain dyes, corrosion inhibitors, metal deactivators and dehazers such as polyester-type ethoxylated alkylphenol-formaldehyde resins. If desired, tetraethyl lead or similar compounds can also be present, if permitted by law.

The additive composition may also contain a polyether amine (PEA) to assist in cleaning and dispersing of deposits found in stored gasoline power equipment. Preferably, the PEA should have a molecular weight of about 600 to 1500. Such materials are well known for use as an engine deposit cleaner.

Typical gasoline suitable for use in spark ignition engines are mixtures of hydrocarbons having a boiling point in the range of about 25° C. to about 232° C., typically comprising mixtures of saturated olefin and aromatic hydrocarbons, blended in various, well known ways. The hydrocarbon composition and octane level of the fuel for treatment in accordance with this invention is not particularly critical, but the octane level is typically at least 85.

The composition may also contain suitable carrier fluids, such as hydrocarbon based materials such as polyisobutylenes, dissolved polypropylenes, and/or polyalphaolefins, which may be saturated or unsaturated. Additionally, polyether based materials such as polybutylene oxides, polypropylene oxides, polyhexadecene oxides and the like, and/or mixtures thereof may be used. Mineral oils may also be present.

The composition may also contain other conventional additives including antioxidants such as phenolic materials of known types, dyes, metal deactivators, and dehazers such as polyester-type ethoxylated alkylphenol-formaldehyde resins. Other suitable ingredients for the composition may comprise other hydrocarbons and mixtures of hydrocarbons with alcohols or ethers. It will be recognized that where the additive composition of the present invention contains a hydrocarbylpoly(oxyalkylene) aminocarbamate or other hydrocarbyl amine component which has been obtained from a commercial supplier, that component may, in addition to the aminocarbamate or amine itself, contain a proportion of diluent and/or carrier fluid. This may comprise unreacted intermediate from the manufacturing process of the amino carbamate or the like; for example, polyether present as a byproduct in the aminocarbamate, or polyisobutylene in the case where the amine is polyisobutyl-amine.

Thus, additive compositions as described above, when added to gasoline which has been stored for a significant period of time, sufficient to cause loss of its more volatile components, can restore such volatile components to the stored gasoline, causing the gasoline to become more capable of easy starting of a motor than would otherwise be the case without the addition of the additive composition of this invention.

The above disclosure, and the examples below, are offered for illustrative purposes only, and are not intended to limit the scope of this invention, which is as described in the claims below.

EXAMPLE 1

An additive composition was prepared by mixing (1) 0.58 gallon of methyl tert-butyl ether (MTBE Lyondell Arcopure, Houston, Tex.); (2) 0.2 gallon of xylene; (3) 0.036 gallon of a PEA (Poly Ether Amine) hydrocarbylpoly(oxyalkylene) aminocarbamate of a molecular weight of about 1200 to 1800 (Chevron OGA 72022); (4) 0.005 gallon of hindered phenolic antioxidant (Octel AO36, sold by INNOSPEC OCTEL); and (5) 0.179 gallon of 99% pure isopropanol.

This material was added to old gasoline, which had been stored on the order of 18 months in a 32 oz. gas tank of a Toro snowblower. About 4 oz. of the additive composition were added to the 32 oz. tank, which was substantially filled with the old gasoline.

Efforts to start the Toro snowblower before adding the additive composition were unsuccessful. After addition of the additive composition, the Toro snowblower started easily.

EXAMPLE 2

The additive composition of Example 1 was added in the amount of 4 oz. to a 2½ gallon gas tank of an ATV, which tank was substantially filled with old gasoline, stored in the tank for a period on a the order of about 18 months. Previous efforts to start the ATV have been unsuccessful. After addition of the 4 oz. of the additive composition of Example 1, the motor of the ATV started without difficulty.

EXAMPLE 3

The additive composition of Example 1 may be modified by replacing 0.02 gallon of the isopropanol ingredient with a polyisobutylene two cycle lubricant (Lubrizol 3108 from Texas Petrochemical Company), to assure effective use of the additive composition with two cycle engines without damaging the engine. Generally equivalent results to those of Examples 1 and 2 can be obtained.

That which is claimed is:

1. A method of rejuvenating stale gasoline which has been previously prepared, purchased and then stored in a container, and has lost its effectiveness for engine starting, including:

adding to the stale gasoline which has previously been prepared, purchased and then stored, in the container, an additive composition which comprises a flammable organic liquid, said flammable organic liquid having a Reid vapor pressure of 2-18 psig, in an amount of about 0.5 to 30 volume percent of the prepared, purchased and then stored gasoline in the container, to rejuvenate the gasoline and thereby improve starting capacity of an engine fueled by said gasoline.

2. The method of claim 1 in which said flammable, organic liquid comprises at least 50 volume percent of an active compound selected from the group consisting of (1) ethers of the formula ROR', where R is methyl or ethyl and R' is a branched alkyl radical of three to six carbon atoms and (2) branched chain hydrocarbons of four to eight carbon atoms.

3. The method of claim 2 in which from 10 to 30 volume percent of an alcohol of no more than six carbon atoms is present in the flammable, organic liquid.

4. The method of claim 3 in which from 10 to 30 volume percent of an aromatic hydrocarbon of no more than eight carbon atoms is present in the flammable, organic liquid.

5. The method of claim 1 in which from 10 to 30 volume percent of an alcohol of no more than six carbon atoms is present in the flammable organic liquid.

6. The method of claim 1 in which from 10 to 30 volume percent of an aromatic hydrocarbon of no more than eight carbon, atoms is present in the flammable organic liquid.

7. The method of claim 1 in which said Reid vapor pressure is 5 to 15 psig.

8. The method of claim 1 in which said flammable organic liquid also contains an effective lubricating amount of a two cycle engine oil.

* * * * *